US006895200B2

(12) United States Patent
Tagansky

(10) Patent No.: US 6,895,200 B2
(45) Date of Patent: May 17, 2005

(54) LIQUID TONER APPLICATION SYSTEM

(75) Inventor: Boaz Tagansky, Rishon-Lezion (IL)

(73) Assignee: Hewlett-Packard Indigo N.V., Ft. Collins, CO (US)

( * ) Notice: Subject to any disclaimer, the term of this patent is extended or adjusted under 35 U.S.C. 154(b) by 79 days.

(21) Appl. No.: 10/257,648

(22) PCT Filed: May 21, 2001

(86) PCT No.: PCT/IL01/00453

§ 371 (c)(1),
(2), (4) Date: Oct. 15, 2002

(87) PCT Pub. No.: WO01/92962

PCT Pub. Date: Dec. 6, 2001

(65) Prior Publication Data

US 2003/0113138 A1 Jun. 19, 2003

Related U.S. Application Data

(60) Provisional application No. 60/208,640, filed on Jun. 1, 2000.

(51) Int. Cl.[7] ..... G03G 15/10

(52) U.S. Cl. ..... 399/240

(58) Field of Search ..... 399/239, 240, 399/241, 244, 248, 249; 430/119; 118/429

(56) References Cited

U.S. PATENT DOCUMENTS 3,901,188 A * 8/1975 Eberlein ..... 399/164
3,972,305 A * 8/1976 Sato ..... 399/238
4,013,356 A * 3/1977 Bestenreiner et al. ..... 399/246
4,110,029 A * 8/1978 Goshima et al. ..... 399/238
4,784,080 A * 11/1988 Bibl et al. ..... 399/242
4,793,281 A * 12/1988 Dobbins et al. ..... 399/244
4,851,317 A * 7/1989 Chuang et al. ..... 430/119
5,120,630 A * 6/1992 Wadlo et al. ..... 430/103
5,502,551 A * 3/1996 Bonino et al. ..... 399/411
5,574,548 A 11/1996 Iino et al.
5,596,396 A 1/1997 Landa et al.
5,689,779 A * 11/1997 Miyamoto et al. ..... 399/237
5,737,660 A 4/1998 Okutsu et al.

FOREIGN PATENT DOCUMENTS

JP 50-152741 12/1975

OTHER PUBLICATIONS

Miyamoto,H.; Patent Abstracts of Japan; Jan. 29, 1999; vol. 1999, No. 01 & JP 10–282795; Oct. 23, 1998.

* cited by examiner

*Primary Examiner*—Robert Beatty
(74) *Attorney, Agent, or Firm*—Lee & Hayes, PLLC

(57) ABSTRACT

A coating system comprising: a rotating roller; an electrode having a surface located adjacent the roller that defines a space between the surface of the roller and the electrode surface, which space has first and second apertures located at different angular positions about the axis of the roller, wherein the electrode surface is formed with at least one drain aperture located between the first and second apertures; a voltage source that applies a voltage difference between the electrode and the roller; and a source of liquid toner comprising charged toner particles dispersed in a carrier liquid that discharges the liquid toner into the space through the first aperture, wherein a portion of the liquid toner discharged into the space coats a region of the surface of the roller that passes by the electrode, a portion exits the space through the second aperture and a portion exits through the at least one drain aperture.

16 Claims, 4 Drawing Sheets

LIQUID TONER APPLICATION SYSTEM

RELATED APPLICATIONS

The present application is a U.S. national application of PCT Application No. PCT/IL01/00453, filed on 21 May 2001, and was published as WO 01/92962. The present application claims the benefit under 35 U.S.C. §119(e) of U.S. Provisional Application No. 60/208,640 filed on Jun. 1, 2000.

FIELD OF THE INVENTION

The present invention relates to printing images on a substrate using liquid toner and in particular to methods of applying toner to the substrate to print the image.

BACKGROUND OF THE INVENTION

Liquid toner comprises toner particles dispersed in a carrier liquid. Printing an image on a substrate using liquid toner involves extracting toner particles from the carrier liquid and depositing the extracted toner particles on the substrate in a pattern suitable to form the image. Once deposited on the substrate the particles are bonded together and to the substrate to provide the finished image.

Toner particles are charged and electric fields are used to transfer toner particles from the carrier liquid and deposit them on the substrate. Generally, the toner particles are dispersed in relatively low concentration in the carrier liquid and printing with liquid toner usually begins with an electrophoretic process that increases toner particle concentration in toner used to print an image.

In some liquid toner printing systems, concentration of toner particles used to form an image is accomplished by a system, hereinafter referred to as an "application system", that comprises a cylinder formed from a conducting material and an associated electrode positioned near to the surface of the cylinder. The cylinder is hereinafter referred to as an "applicator" and the electrode is referred to as a "concentration electrode". The concentration electrode has a surface facing the applicator that is a portion of a cylinder having its axis with the axis of the applicator. This surface of the concentration electrode and the surface of the applicator form a narrow uniform space, hereinafter referred to as a "application space", between the concentration electrode and the applicator. A projection of the surface of the concentration electrode onto the surface of the applicator shadows a relatively narrow area on the surface having a length substantially equal to the length of the applicator. The application space has an inlet aperture and an outlet aperture substantially parallel to the axis of the applicator. The applicator is rotated about its axis and toner is pumped from a suitable reservoir so that it enters the application space through the inlet aperture, flows through the application space and exits the application space through the outlet aperture.

A voltage difference is applied between the applicator and the concentration electrode to generate an electric field, hereinafter referred to as an "application space electric field", in the application space. The direction of the electric field in the application space is such that toner particles in toner flowing through the application space migrate towards the surface of the applicator. As the applicator rotates, regions of its surface "enter" and pass through the application space passing by the concentration electrode. As a surface region of the applicator passes through the application space, toner particles in toner flowing in the application space migrate to and adhere to the surface region. When the surface region leaves the application space it is covered with a thin layer of toner in which the concentration of toner particles is substantially greater than that of toner particles in toner in the reservoir. A squeegee roller contacts the region after it leaves the application space and removes excess carrier liquid from the toner layer. A voltage difference is maintained between the squeegee and the applicator that repels toner particles from the squeegee and enhances concentration of toner particles. Concentration of toner particles in the toner layer covering the surface region after it is "squeegeed" is determined by the voltage differences between the applicator and the concentration electrode and between the applicator and the squeegee.

The applicator contacts a photoconducting surface on which an electrographic image corresponding to the image to be printed is formed using methods and devices known in the art. Generally, the photoconducting surface is a surface of a cylinder, hereinafter referred to as an "imaging roller", that rotates in a direction opposite to the direction of rotation of the applicator. The applicator rolls on the imaging roller and transfers toner particles to regions of the imaging roller responsive to voltage differences between the applicator and the electrographic image on the imaging roller. In some printing systems toner from the imaging roller is transferred directly to the substrate to form the image. In other imaging systems, toner from the imaging roller is transferred to an intermediate transfer member, which in turn transfers the toner to the substrate. Perceived quality of the printed image depends, inter alia, on uniformity of a layer of toner particles deposited on printed regions of the substrate and the density, hereinafter referred to as "area density", of toner particles in the layer per unit area of printed substrate.

Liquid toner printing systems in which toner particles are extracted from liquid toner using an application system of the type described above and transferred to a substrate to print an image on the substrate are described in U.S. Pat. Nos. 5,596,396 and 5,737,660, the disclosures of which are incorporated herein by reference.

SUMMARY OF THE INVENTION

An aspect of some embodiments of the present invention relates to providing an improved liquid toner printing system that provides printed images having improved perceived quality.

An aspect of the present invention relates to providing an improved toner application system for use in liquid toner printing system.

The uniformity and area density of a layer of toner in a region of a printed image is dependent upon uniformity and area density of a layer of toner particles on the imaging roller that is used to deposit the toner layer on the region. Uniformity and area density of the toner layer on the imaging roller is in turn dependent upon uniformity and area density of toner on the application roller that transfers toner to the electrographic image on the imaging roller. Toner layers deposited on an applicator comprised in an application system in accordance with an embodiment of the present invention are generally characterized by greater uniformity than toner layers deposited on applicators in prior art application systems. As a result, images printed using the improved application system are perceived to have improved quality in comparison to images printed using prior art printing systems using conventional application systems.

In accordance with embodiments of the present invention a toner concentration electrode in the toner application system is formed with at least one drain aperture located between the inlet and outlet apertures of the application space. A portion of toner entering the inlet aperture exits the application space through the drain aperture rather than through the outlet aperture of the application space.

The inventors have found that as a result of addition of the at least one drain aperture, toner flowing in the application space exhibits less turbulence than toner flowing in an application space in prior art application systems.

In addition the inventors have found that voltage differences between the applicator and the concentration electrode and the applicator and squeegee can be reduced in comparison to voltage differences used in prior art application system. As toner flows in the application space as charged toner particles migrate towards the applicator and particles in the toner liquid having a charge opposite to that of the toner particles migrate to the concentration electrode. Separation of the charged particles caused by the migration generates a "polarization" electric field in the application space having a direction opposite to that of the electric field generated by the voltage difference between the concentration electrode and the applicator. The polarization field reduces efficacy of the applied voltage difference in causing toner particles to migrate towards the applicator. The drain aperture is believed to preferentially "drain off" charged toner fluid near the concentration electrode and reduces thereby the polarization field.

The reduced polarization field improves the efficacy of the applied voltage and enables an application system, in accordance with a some embodiments of the present invention, to be operated with a reduced voltage difference between the applicator and the concentration electrode. In some embodiments of the present invention voltage differences between the applicator and the concentration electrode are reduced by as much as 25% in comparison to prior art application systems.

The inventors have found that the improved flow and reduced voltages improves, uniformity of toner layers deposited on the applicator. Toner layers in images printed with a liquid toner printing system using an application system in accordance with embodiments of the present invention are therefore generally more uniform than toner layers in images printed with prior art liquid toner printing systems.

There is therefore provided, in accordance with an embodiment of the present invention, a coating system comprising: a rotating roller; an electrode having a surface located adjacent the roller that defines a space between the surface of the roller and the electrode surface, which space has first and second apertures located at different angular positions about the axis of the roller, wherein the electrode surface is formed with at least one drain aperture located between the first and second apertures; a voltage source that applies a voltage difference between the electrode and the roller; and a source of liquid toner comprising charged toner particles dispersed in a carrier liquid that discharges the liquid toner into the space through the first aperture, wherein a portion of the liquid toner discharged into the space coats a region of the surface of the roller that passes by the electrode, a portion exits the space through the second aperture and a portion exits through the at least one drain aperture.

Optionally, the roller rotates so that points on its surface opposite the electrode move towards the second aperture.

Alternatively or additionally the electrode has ends located at different angular positions about the roller axis and the first aperture is located between the ends.

In some embodiments of the present invention the electrode surface is a portion of a cylindrical surface having an axis congruent with the axis of the roller. In some embodiments of the present invention, the radius of curvature of the electrode is greater than the radius of curvature of the roller by an amount less than a millimeter. In some embodiments of the present invention the radius of curvature of the electrode is greater than the radius of curvature of the roller by an amount between 0.2 and 0.6 millimeters.

In some embodiments of the present invention the radius of the roller is less than 30 millimeters. In some embodiments of the present invention the radius of curvature of the roller is between 6 and 25 millimeters.

In some embodiments of the present invention the drain aperture is located at an angular position displaced from the first aperture equal to about ⅓ the angular distance between the first and second apertures.

In some embodiments of the present invention, the portion of the toner that leaves the space through the drain aperture less than half of the toner that is discharged into the space. In some embodiments of the present invention the portion of the toner that leaves the space through the drain aperture less than one third of the toner that is discharged into the space.

In some embodiments of the present invention the carrier liquid comprises counter-ions and the voltage difference causes the counter-ions to migrate towards the electrode and the charged toner particles to migrate towards and coat the roller. Generally, toner that exits through the at least one drain aperture comprises a higher concentration of counter-ion particles than toner particles.

In some embodiments of the present invention flow of the liquid toner in the space is laminar and the drain aperture siphons toner substantially only from a layer of toner contiguous with the electrode in which counter-ion particles that have migrated to the electrode are concentrated.

In some embodiments of the present invention the at least one drain aperture comprises a plurality of apertures.

There is further provided, in accordance with an embodiment of the present invention, a printing system for printing an image on a substrate using liquid toner comprising: an imaging roller having a surface on which an electrographic image corresponding to the image to be printed is formed; and a coating system according to any of the preceding claims wherein the surface of the roller contacts the surface of the imaging roller; and wherein toner coated on the roller is transferred to the surface of the imaging roller responsive to the charge distribution of the electrographic image and the imaging roller rolls on the substrate and transfers toner it has received from the roller to the substrate.

BRIEF DESCRIPTION OF FIGURES

Non-limiting embodiments of the present invention are described below with reference to figures attached hereto. In the figures, identical structures, elements or parts that appear in more than one figure are generally labeled with the same numeral in all the figures in which they appear. Dimensions of components and features shown in the figures are chosen for convenience and clarity of presentation and are not necessarily shown to scale. The figures are listed below.

DETAILED DESCRIPTION OF EMBODIMENTS

Figure 1:
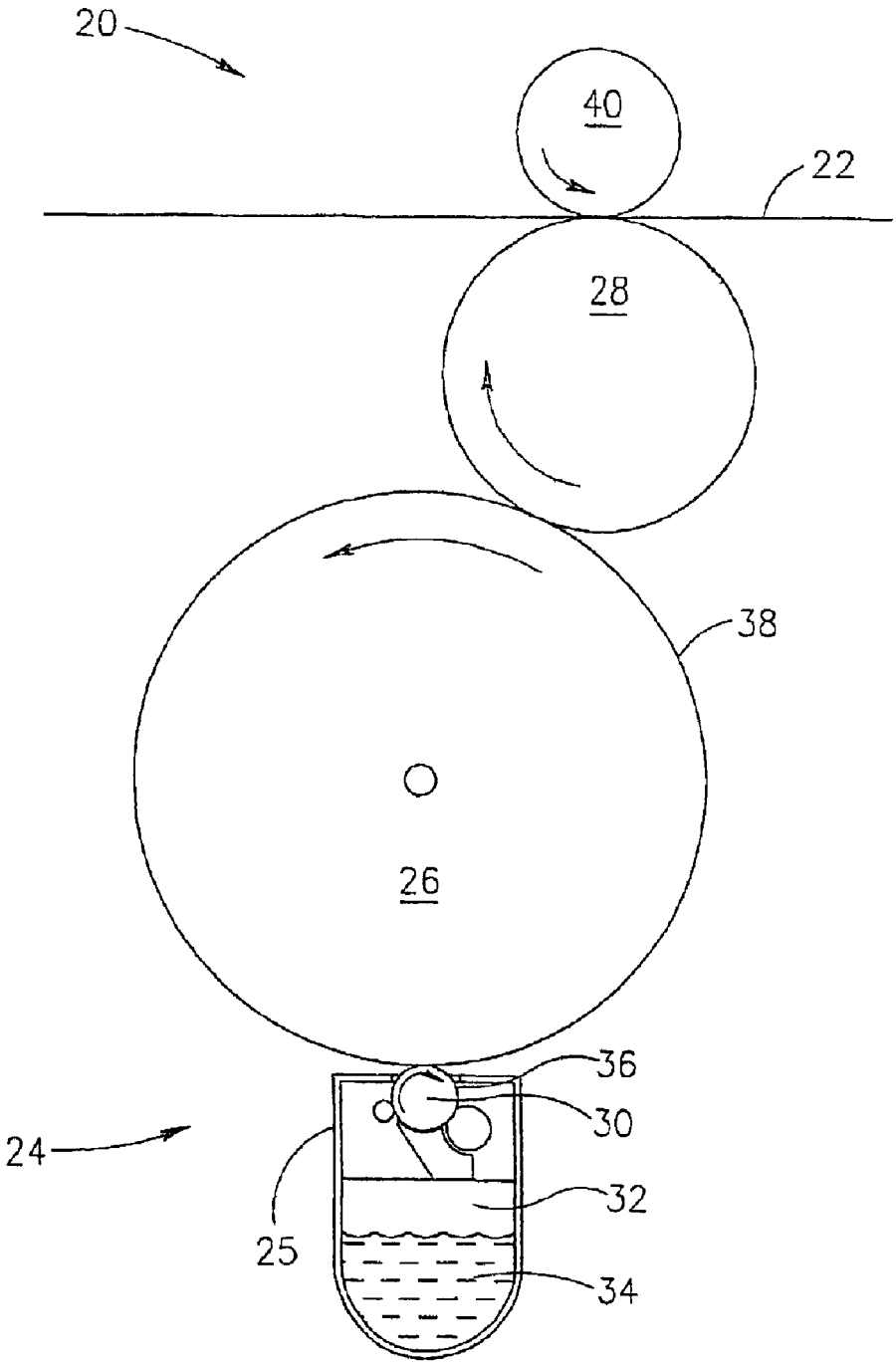
FIG.1 PRIOR ART
FIG. 1 schematically shows a prior art application system comprised in a liquid toner printing system.

FIG. 1 schematically shows a cross sectional view of a simplified liquid toner printing system 20 printing an image on a substrate 22 in accordance with prior art. Printing system 20 comprises a toner application system 24, an imaging roller 26 and an intermediate transfer member 28. A curved arrow inside imaging roller 26 and intermediate transfer roller 28 indicates a direction of rotation of the roller and intermediate transfer member.

Figure 2:
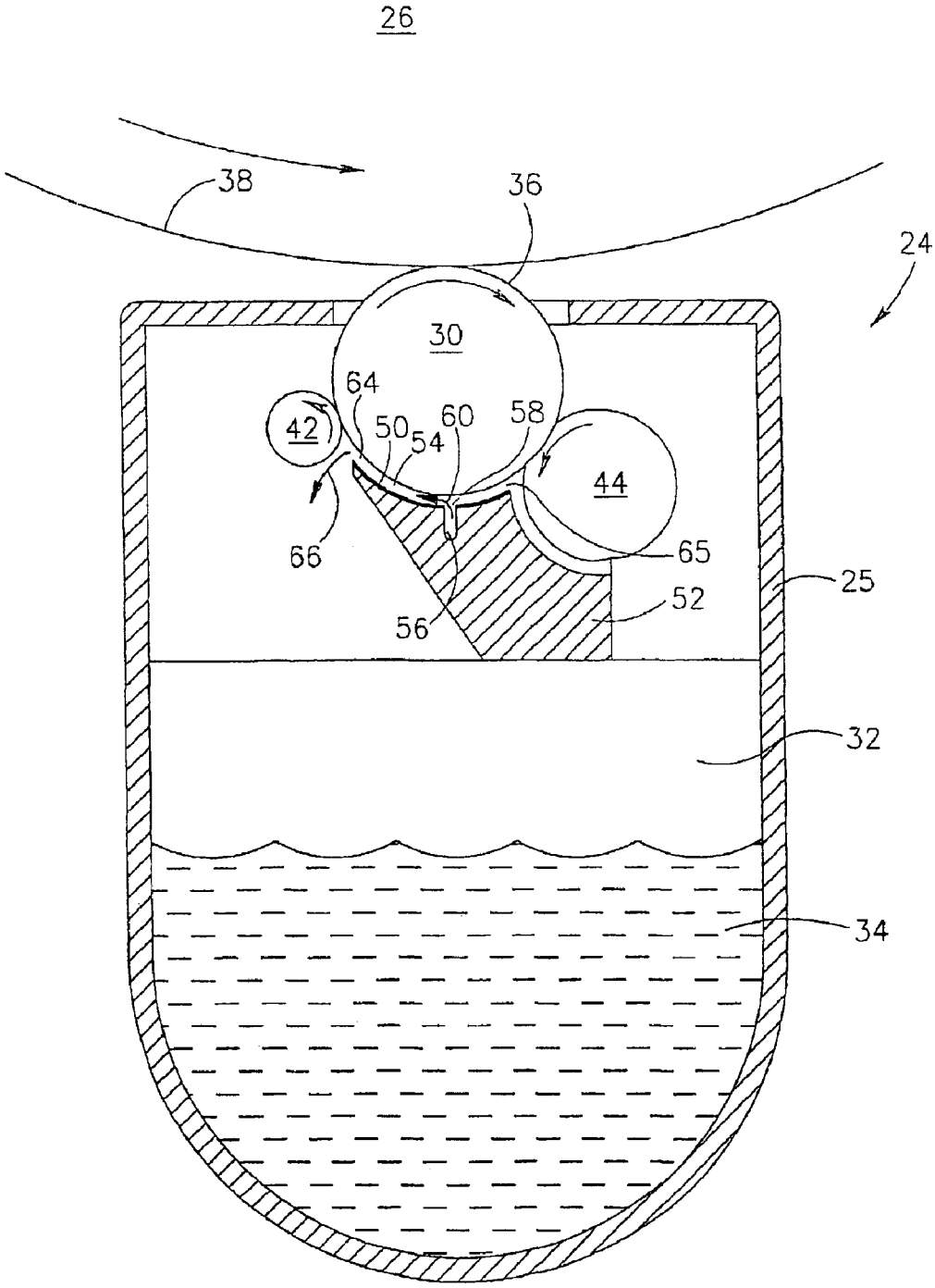
FIG.2 PRIOR ART
FIG. 2 schematically shows details of the application system shown in FIG. 1.

Application system 24 comprises an applicator 30 and a reservoir 32 containing toner 34. Generally, application system 24 comprises a housing 25 in which components of application system 24 are mounted. Applicator 30 rotates in a direction shown by the curved arrow inside the applicator. Application system 24 pumps toner from reservoir 32 to form a thin layer of liquid toner comprising a high concentration of toner particles on a surface 36 of applicator 30. Details of components and features of toner application system 24 are shown in FIG. 2 and discussed below.

Applicator 30 contacts a surface 38 of imaging roller 26 on which an electrographic image is formed responsive to the image being printed on substrate 22. Regions of the electrographic image corresponding to regions of substrate 22 to be printed with toner are at a first voltage level. Regions of the electrographic image that correspond to regions of substrate 22 that are not to be printed with toner are charged to a second voltage level.

Apparatus for forming the electrographic image on imaging roller 26 is not shown in FIG. 1. Methods and devices for forming an electrographic image on an imaging roller are well known in the art any of these methods and devices are useable in the practice of the present invention to generate the electrographic image on imaging roller 26. Applicator 30 and imaging roller 26 rotate in opposite directions so that applicator 30 rolls on surface 38 of imaging roller 26.

Applicator 30 is maintained at an "application" voltage level, which is between the first and second voltage levels of the electrographic image. By way of example, toner particles are usually negatively charged and typically the first voltage level on imaging roller 26 is between 0 and −200 volts, the second voltage level is about −1000 volts and voltage on applicator 30 is between −550 to −600 volts. As applicator 30 rolls along surface 38 of imaging roller 26 toner is transferred from the applicator to regions of the electrographic image that are charged to the first voltage level. Imaging roller 26 transfers toner that it receives from applicator 30 to intermediate transfer roller 28 which in turn transfers the toner to substrate 22 to form the image. Substrate 22 is pressed to intermediate transfer roller 28 by a backing roller 40. Some printing systems do not comprise an intermediate printing member and for such systems an imaging roller transfers toner from its surface directly to a substrate being printed with an image by the printing system.

FIG. 2 schematically shows an enlarged cross sectional view of toner application system 24 shown in FIG. 1 that shows details of the application system. Application system 24 comprises a squeegee roller 42 and a cleaning roller 44 that are resiliently pressed to surface 36 of applicator 30 using methods and devices known in the art, such as those described in the above cited U.S. patents. A portion of surface 38 of imaging roller 26 on which applicator 30 rolls is shown in FIG. 2. A curved arrow located inside each roller shows direction of rotation of the roller. A concentration electrode 50 is located on an electrode pedestal 52. A space 54 between electrode 50 and surface 36 of applicator 30 is an application space 54 of toner application system 24.

Assuming that toner particles in liquid toner 34 are charged negatively, concentration electrode 50 and squeegee 42 are maintained at voltage levels that are more negative than a voltage level at which applicator 30 is maintained. If voltage on applicator 30 is between (−300) to (−600) volts as noted above, voltage on concentration electrode 50 is typically in a range from (−1000) to (−2000) volts. Squeegee roller 42 voltage is typically between 300 to 500 volts more negative than applicator 30 voltage.

A pump (not shown) pumps liquid toner 34 from reservoir 32 through a channel (not shown) in pedestal 52 that communicates with a "feed" channel 56 having an orifice 58 that communicates with application space 54. Orifice 58 is an inlet aperture for application space 54 and will be hereinafter be referred to as "inlet aperture 58". Pumped liquid toner flows out from inlet aperture 58 in a direction indicated by a bold arrow 60 and flows into application space 54. A relatively moderate portion, in some embodiments about ⅓, of the pumped liquid toner flows "against" the rotation direction of applicator 30 and flows out through an aperture 65 between pedestal 52 and applicator 30. The portion of pumped toner that flows out through aperture 65 is a function inter alia of a distance between orifice 58 and aperture 65 and decreases as this distance increases. In some embodiments, applicator 30 has a radius of about 20 mm and an application space 54 has a width (i.e. a dimension parallel to a radius of applicator 30) between 200 to 600 microns and a length between apertures 64 and 65 of about 3 mm. In some embodiments applicator 30 rotates so that surface 36 has a linear surface speed of about 1.2 m/s. In some embodiments liquid toner has a viscosity of a few centipoise and at a pressure differential of about 500 Pa between orifice 58 and aperture 64 about two thirds of the toner that enters application space 54 through orifice 58 flows out of aperture 64.

As application roller 30 rotates, regions of its surface enter application space 54 and roll by concentration electrode 50. As a result in the difference in voltage between concentration electrode 50 and surface 36, when a region of surface 36 rolls by electrode 50 and passes through application space 54, toner particles in the liquid toner that flows into application space 54 migrate and adhere to the surface region. Some of the toner carrier liquid also adheres to the surface region. As a result, a thin layer of "concentration toner" is formed on the surface region. Carrier fluid and toner particles pumped into application space 54 that do not adhere to the surface region exit application space 54 through an outlet aperture 64 in a direction indicated by arrow 66 and flow back to reservoir 32. As the surface region leaves application space 54, squeegee 42 removes excess liquid from the toner layer on the surface region and further increases the concentration of toner particles in the toner layer on applicator 30, which excess liquid flows back to reservoir 32.

As applicator 30 continues to rotate, the region of surface 36 covered with the concentrated layer of toner comes into contact with surface 38 of imaging roller 26. When in contact with surface 38 the region deposits toner onto surface 38 responsive to voltage differences between the applicator and the electrographic image on surface 38 as noted above. Depending upon the magnitude of voltage differences between applicator 30 and regions of the electrographic image to which toner is deposited, all or a portion of thickness of a toner layer on applicator 30 that contacts a region of the electrographic image is transferred to the region. After transferring toner to imaging roller 26, the surface region rotates to the location of cleaning roller 44, which removes toner remaining on the surface region. The applicator surface region then returns to application space 54 and repeats the cycle of "picking" up toner and transferring it to imaging roller 26.

Figure 3:
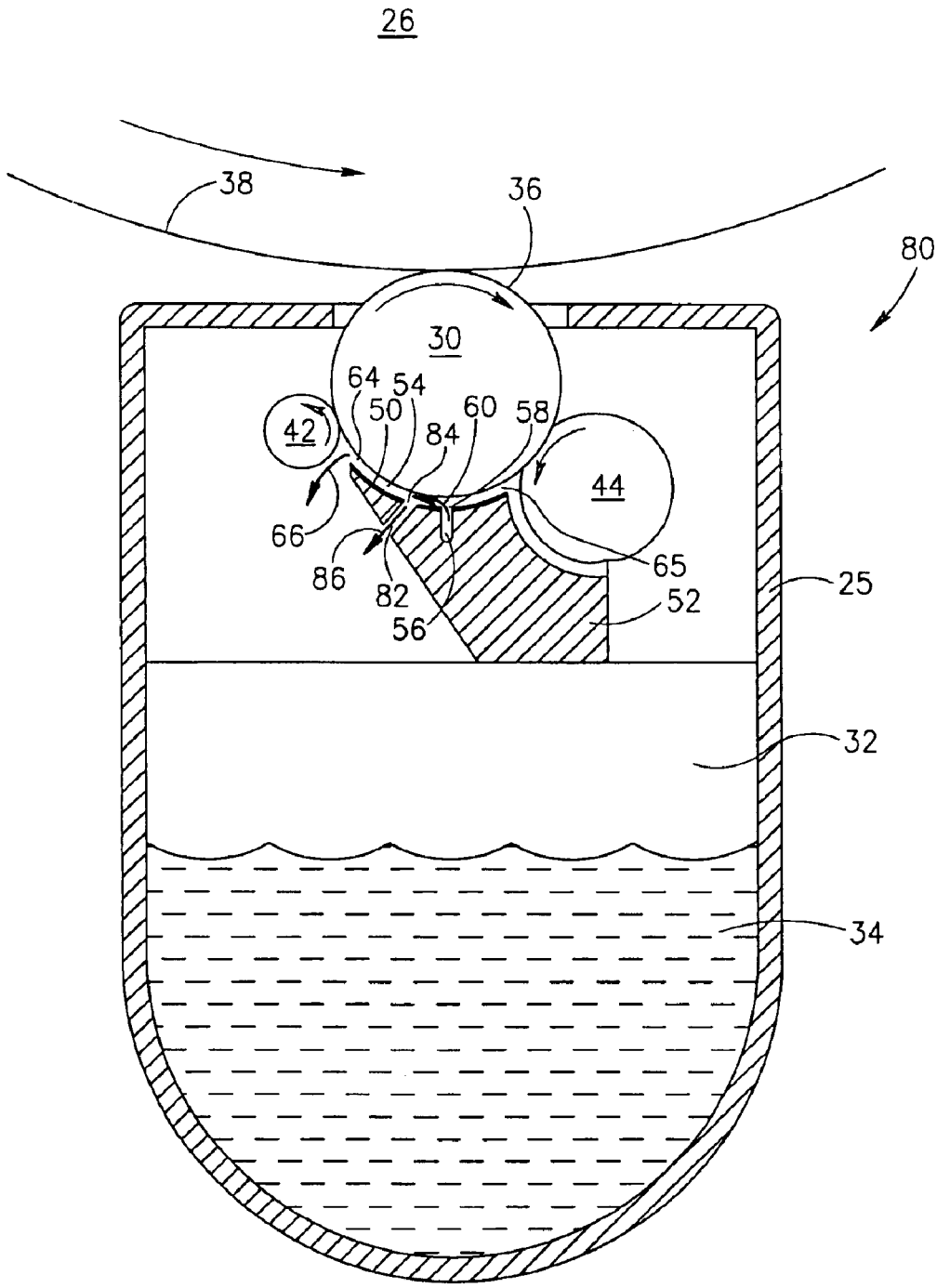
FIG. 3 schematically shows an application system comprising a drain channel, in accordance with an embodiment of the present invention.

FIG. 3 shows details of an application system 80 according to an embodiment of the present invention.

Application system 80 is similar to application system 24. However, concentration electrode pedestal 52 is formed with at least one drain channel 82 having a drain inlet aperture 84 that communicates with application space 54. Drain inlet aperture 84 is located between inlet aperture 58 and outlet aperture 64 of application space 54. In application system 80, toner pumped into application space 54 through feed channel 56 that does not adhere to a region of surface 36 of applicator 30, flows out of application space 54 through drain channel 82 as well as through outlet aperture 64. Flow in application space 54 is believed to be laminar. Preferably a size for drain channel 82 is determined so that drain channel 82 preferentially drains toner flowing near to the surface of applicator 54. Toner that is not drained through drain channel 82 leaves application space 54 through outlet aperture 64. In some embodiments of the present invention, drain channel 84 drains a portion of toner flowing in application space 54 that is less than or equal to about 30% of the amount of toner entering application space 54 through inlet aperture 58. Flow of toner through drain channel 82 is indicated by bold arrow 86.

Whereas the addition of drain channel 82 requires an augmented flow of toner into and through application space 54 the inventors have found that toner flow through the application space exhibits less turbulence than in prior art application system. In particular, turbulence is reduced at outlet aperture 64 of application space 54 and in a region near to where squeegee roller 42 contacts applicator 30.

In addition, the inventors have found that drain channel 82 enables application system 80 to be operated with reduced voltage differences between applicator 30 and concentration electrode 50. As toner that enters application space 54 flows towards outlet aperture 64, negative toner particles that migrate towards applicator 30 leave behind opposite charged particles in the toner carrier liquid that migrate towards and concentrate near the surface of concentration electrode 50. Two layers of oppositely charged particles are thus formed in the toner flowing in application space 54 and the charge densities in the layers tends to increase towards outlet aperture 64. The toner layer becomes polarized with the polarization increasing towards outlet aperture 64. The layers generate an electric "polarization" field having a direction opposite to that generated by the applied voltage difference between concentration electrode 50 and applicator 30. The polarization field reduces the effective electric field in toner flowing in application space 54 that concentrates toner particles on roller 30. Drain channel 82 siphons off liquid toner near to the surface of electrode 50 and reduces the charge density of the charged toner layer near the surface of the electrode. The reduced charge density in the layer reduces the polarization field in the liquid toner and increases the efficacy of the applied voltage difference between concentration electrode 50 and applicator 30 in causing toner particles to migrate towards applicator 30. As a result, the voltage difference between concentration electrode 50 and applicator 30 in application system 80 can be reduced in comparison to voltage differences used on prior art application systems. In some embodiments of the present invention, voltage differences used in application system 80 are reduced by as much as 25% in comparison to voltage differences used in prior art application systems.

The reduced voltage differences and improved flow result in toner layers formed on applicator 30 of application system 80 that are more uniform than toner layers formed on applicator 30 in prior art application system 24 shown in FIGS. 1 and 2.

Figure 4:
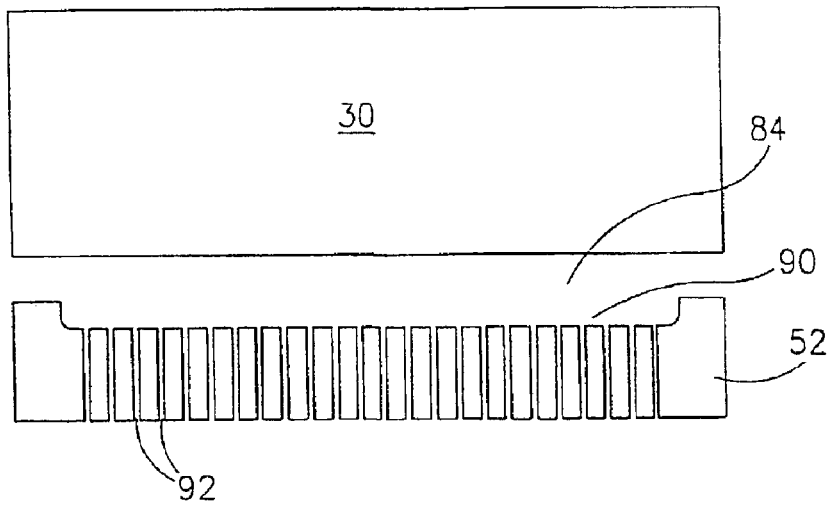
FIG. 4 schematically shows details of a drain channel, in accordance with an embodiment of the present invention.

At least one drain channel 82 can be configured according to various different geometries. FIG. 4 schematically shows a cross sectional view of at least one drain channel 82 according to an embodiment of the present invention. The cross sectional view shown in FIG. 4 is in a plane through electrode pedestal 52 perpendicular to the plane of FIG. 3 and shows application space 54 and applicator 30.

Drain channel 82 optionally comprises a trough 90 and a plurality of "spigot" channels 92. Trough 90 communicates with application space 54 and forms inlet aperture 84, shown also in FIG. 3, of at least one drain channel 82. Spigot channels 92 drain toner that flows into trough 90 from application space 54 to reservoir 32 (FIG. 3).

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art. The scope of the invention is limited only by the following claims.

What is claimed is:

1. A coating system comprising:

a rotating roller;

an electrode having a surface located adjacent the roller that defines a space between the surface of the roller and the electrode surface, which space has first and second apertures located at different angular positions about the axis of the roller, wherein the electrode surface is formed with at least one drain aperture located between the first and second apertures;

a voltage source that applies a voltage difference between the electrode and the roller; and a source of liquid toner comprising charged toner particles dispersed in a carrier liquid that discharges the liquid toner into the space through the first aperture, wherein a portion of the liquid toner discharged into the space coats a region of the surface of the roller that passes by the electrode, a portion exits the space through the second aperture and a portion exits through the at least one drain aperture.

2. A coating system according to claim 1 wherein the roller rotates so that points on its surface opposite the electrode move towards the second aperture.

3. A coating system according to claim 1 wherein the electrode has ends located at different angular positions about the roller axis and the first aperture is located between the ends.

4. A coating system according to claim 1 wherein the electrode surface is a portion of a cylindrical surface having an axis congruent with the axis of the roller.

5. A coating system according to claim 4 wherein the radius of curvature of the electrode is greater than the radius of curvature of the roller by an amount less than a millimeter.

6. A coating system according to claim 4 wherein the radius of curvature of the electrode is greater than the radius of curvature of the roller by an amount between 0.2 and 0.6 millimeters.

7. A coating system according to claim 5 wherein the radius of the roller is less than 30 millimeters.

8. A coating system according to claim 5 wherein the radius of curvature of the roller is between 6 and 25 millimeters.

9. A coating system according to claim 1 wherein the drain aperture is located at an angular position displaced from the first aperture equal to about ⅓ the angular distance between the first and second apertures.

10. A coating system according to claim 1 wherein the portion of the toner that leaves the space through the drain aperture is less than half of the toner that is discharged into the space.

11. A coating system according to claim 1 wherein the portion of the toner that leaves the space through the drain aperture is less than one third of the toner that is discharged into the space.

12. A coating system according to claim 1 wherein the carrier liquid comprises counter-ions and the voltage difference causes the counter-ions to migrate towards the electrode and the charged toner particles to migrate towards and coat the roller.

13. A coating system according to claim 12 wherein toner that exits through the at least one drain aperture comprises a higher concentration of counter-ion particles than toner particles.

14. A coating system according to claim 12 wherein flow of the liquid toner in the space is laminar and the drain aperture siphons toner substantially only from a layer of toner contiguous with the electrode in which counter-ion particles that have migrated to the electrode are concentrated.

15. A coating system according to claim 1 wherein the at least one drain aperture comprises a plurality of apertures.

16. A printing system for printing an image on a substrate using liquid toner comprising:

an imaging roller having a surface on which an electrographic image corresponding to the image to be printed is formed; and a coating system according to any of the preceding claims wherein the surface of the roller contacts the surface of the imaging roller; and wherein toner coated on the roller is transferred to the surface of the imaging roller responsive to the charge distribution of the electrographic image and the imaging roller rolls on the substrate and transfers toner it has received from the roller to the substrate.

* * * * *